US008451309B2

(12) United States Patent
Suhara

(10) Patent No.: US 8,451,309 B2
(45) Date of Patent: May 28, 2013

(54) OPTICAL SCANNING APPARATUS AND IMAGE FORMING APPARATUS

(75) Inventor: Hiroyuki Suhara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 393 days.

(21) Appl. No.: 12/694,521

(22) Filed: Jan. 27, 2010

(65) Prior Publication Data

US 2010/0196052 A1 Aug. 5, 2010

(30) Foreign Application Priority Data

Feb. 2, 2009 (JP) ..... 2009-021787

(51) Int. Cl.
*B41J 27/00* (2006.01)
*G03G 15/04* (2006.01)

(52) U.S. Cl.
USPC ..... 347/260; 399/177

(58) Field of Classification Search
USPC ..... 347/129, 234, 224; 250/234
See application file for complete search history.

(56) References Cited

U.S. PATENT DOCUMENTS

| | | | | |
|---|---|---|---|---|
| 7,239,148 | B2 | 7/2007 | Suhara | |
| 7,400,839 | B2 | 7/2008 | Suhara | |
| 7,403,316 | B2 | 7/2008 | Amada | |
| 2003/0218665 | A1* | 11/2003 | Yasutomi et al. | 347/129 |
| 2004/0031915 | A1* | 2/2004 | Ito et al. | 250/234 |
| 2008/0056746 | A1 | 3/2008 | Suhara | |
| 2008/0088316 | A1 | 4/2008 | Suhara | |
| 2008/0170282 | A1 | 7/2008 | Amada et al. | |
| 2008/0253792 | A1 | 10/2008 | Suhara | |
| 2009/0051982 | A1 | 2/2009 | Suhara | |
| 2009/0220256 | A1 | 9/2009 | Suhara et al. | |

FOREIGN PATENT DOCUMENTS

| | | | |
|---|---|---|---|
| JP | 2000-137339 A | | 5/2000 |
| JP | 2000137339 | * | 5/2000 |
| JP | 2004-077714 A | | 3/2004 |
| JP | 2007093594 | * | 4/2007 |
| JP | 2008-096347 A | | 4/2008 |
| JP | 2008096347 | * | 4/2008 |
| JP | 2008-170888 A | | 7/2008 |
| JP | 2009-053322 A | | 3/2009 |

* cited by examiner

*Primary Examiner* — Stephen Meier
*Assistant Examiner* — Carlos A Martinez
(74) *Attorney, Agent, or Firm* — Dickstein Shapiro LLP

(57) ABSTRACT

An optical scanning apparatus includes an optical deflector that deflects a light beam at a substantially constant angular velocity and an optical system that condenses the deflected light beam onto a to-be-scanned surface thereby performing optical scanning of the to-be-scanned surface. The to-be-scanned surface is a surface of a latent image carrier having a charge generation layer that generates carriers and a charge transport layer. A driving unit drives the optical deflector at a scanning frequency at which exposure is attained in a state where the carriers generated at the charge generation layer of the latent image carrier substantially stay still.

11 Claims, 16 Drawing Sheets

Vacc: ACCELERATION VOLTAGE
Vsub: VOLTAGE IMPOSED ON BOTTOM OF SAMPLE

Vth=Vacc-Vsub

S1: DELAY TIME PRODUCED BY ONE-SURFACE EXPOSURE
S2: SCANNING TIME FOR ONE-TO-TWO SURFACE EXPOSURE

Sm: SCANNING TIME FOR ONE-TO-m SURFACE EXPOSURE
Sn: SCANNING TIME FOR ONE-TO-n SURFACE EXPOSURE $$\tanh(x) = \frac{\exp(x) - \exp(-x)}{\exp(x) + \exp(-x)}$$

OPTICAL SCANNING APPARATUS AND IMAGE FORMING APPARATUS

CROSS-REFERENCE TO RELATED APPLICATIONS

The present application claims priority to and incorporates by reference the entire contents of Japanese Patent Application No. 2009-021787 filed in Japan on Feb. 2, 2009.

BACKGROUND OF THE INVENTION

1. Field of the Invention

The present invention is generally directed to an optical scanning apparatus adaptable for use in an electrostatic-latent-image forming apparatus, a carrier-transit-time measuring apparatus, or the like, and to an image forming apparatus, such as a digital copying machine, a laser printer, a laser facsimile, or a multifunction product providing two or more functions thereof, that includes the optical scanning apparatus.

2. Description of the Related Art

Conventionally, an optical scanning apparatus that forms a latent image by causing a light beam emitted from a light source, such as a laser diode (LD), to pass through a scanning optical system that includes a light deflection unit (e.g., an optical deflector, such as a polygon mirror) so as to form an image on a to-be-scanned surface of an image carrier (e.g., a photo-conductive photosensitive member) is known. Such an optical scanning apparatus is used as a latent-image forming unit of an electrophotographic image forming apparatus (e.g., a digital copying machine, a laser printer, a laser facsimile, a multifunction product that provides two or more functions thereof). Along with advent of high-speed, high-density image forming apparatuses, an optical scanning apparatus that includes a multi-beam scanning optical system that performs scanning with a plurality of light beams simultaneously to thereby write a plurality of lines in the sub-scanning direction simultaneously has been proposed.

A photosensitive member for use as a latent image carrier of an electrophotographic image forming apparatus can exhibit a reciprocity law failure phenomenon, in which even when the photosensitive member receives a same total exposure energy density, a state of latent image formed on the photosensitive member varies depending on a combination of light quantity and exposure duration. More specifically, the reciprocity law failure phenomenon occurs such that a change in electric potential on a photosensitive member that receives exposure of very short duration is smaller than that on a photosensitive member that receives exposure of relatively long duration even when total exposures thereof are equal to each other.

This is considered to be caused by an increase in the number of recombined carriers due to a large quantity of light, which causes a decrease in the number of carriers that reach a surface. With a multi-beam-scanning optical system, this results in uneven image density.

FIG. 19 illustrates an example where an image forming apparatus uses a 4-channel laser diode array (4ch-LDA), in which four laser diodes LD1 to LD4 are arranged, as a scanning optical system. Because a boundary area between the LD1 and the LD2 is exposed by both of them, the boundary area receives a large quantity of light during a short duration. In contrast, because a boundary area between the LD4 and the LD1 is exposed such that the LD4 is exposed first and thereafter the LD1 is exposed, there is produced a time lag that causes the boundary area to receive weak light for a long duration. In this case, a latent image formed by exposure with the time lag has deeper electric potential distribution and hence more likely to attract toner. Accordingly, image density at the boundary area between the LD4 and the LD1 becomes thicker than that at the other portions, which results in uneven image density.

The reciprocity law failure phenomenon as mentioned above particularly depends on, among characteristics of a photosensitive member, the thickness of a charge generation layer (CGL) of an organic photoconductor (OPC), carrier mobility, quantum efficiency, and the number of generated carriers, for example. Therefore, it is desirable to provide an image forming system that includes a photosensitive member and a scanning optical system that causes reciprocity law failure less likely to occur; however, a spatial resolution of as low as approximately several millimeters has been achieved with a conventional measurement method, which is insufficient for analysis of mechanism. Therefore, there has been no choice but to determine optimum exposure condition only based on an output image and light quantity has been adjusted so as to prevent uneven density based on the output image as a stopgap solution.

This method is also disadvantageous in that, because it requires adjustment of output power of each of light sources, when the number of the light sources increases, the number of combinations increases enormously, which not only makes it difficult to perform the adjustment but also makes it difficult to obtain an image stably.

An example conventional technique that aims at obtaining a high-quality image by preventing image quality degradation caused by reciprocity law failure even when scanning is performed with multiple beams is disclosed in Japanese Patent Application Laid-open No. 2004-77714. It is described that "employment of interlaced scanning allows, with any pair of neighboring scanning lines, a scanning number j of one of the pair to differ from the other one of the pair, thereby making scanning interval to be longer than a period of time of a single main-scanning stroke. As a result, degradation in image quality due to banding caused by reciprocity law failure can be reduced by a large extent and an image that is practically unlikely recognized as having image quality defect is obtained."

The conventional technique disclosed in Japanese Patent Application Laid-open No. 2004-77714 employs interlaced scanning; thereby reducing degradation in image quality due to influence of banding caused by reciprocity law failure.

However, the conventional technique is disadvantageous in not taking characteristics of a photosensitive member, which is a latent image carrier, into consideration even though a main cause of reciprocity law failure is the characteristics of the photosensitive member.

SUMMARY OF THE INVENTION

It is an object of the present invention to at least partially solve the problems in the conventional technology.

According to an aspect of the present invention, there is provided an optical scanning apparatus including an optical deflector having deflective reflection surfaces that deflect a light beam at a substantially constant angular velocity; an optical system that condenses a light beam deflected from the reflection surface of the optical deflector into a light spot on a to-be-scanned surface thereby performing optical scanning of the to-be-scanned surface at the substantially constant velocity. The to-be-scanned surface is a surface of a latent image carrier having a charge generation layer that generates carriers and a charge transport layer. A driving unit drives the optical deflector at a scanning frequency at which exposure is attained in a state where the carriers generated at the charge generation layer of the latent image carrier substantially stay still.

According to another aspect of the present invention, there is provided an image forming apparatus that forms an electrostatic latent image on a latent image carrier by optical scanning and develops the electrostatic latent image into a visible image to thereby record a desired image, the image forming apparatus including the above optical scanning apparatus.

According to still another aspect of the present invention, there is provided an image forming apparatus that forms an electrostatic latent image on a latent image carrier that uses distilbene compound as charge transport material by optical scanning and develops the electrostatic latent image into a visible image to record a desired image, the image forming apparatus including the above optical scanning apparatus.

According to still another aspect of the present invention, there is provided an image forming apparatus that forms an electrostatic latent image on a latent image carrier by optical scanning and develops the electrostatic latent image into a visible image to record a desired image, the image forming apparatus including the above optical scanning apparatus and the latent image carrier has actual transit time that is equal to or shorter than 1 millisecond, the actual transit time being actual transit time of the carriers that drift from the charge generation layer to a surface of the latent image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings.

A first embodiment of the present invention will be described below.

Figure 1A:
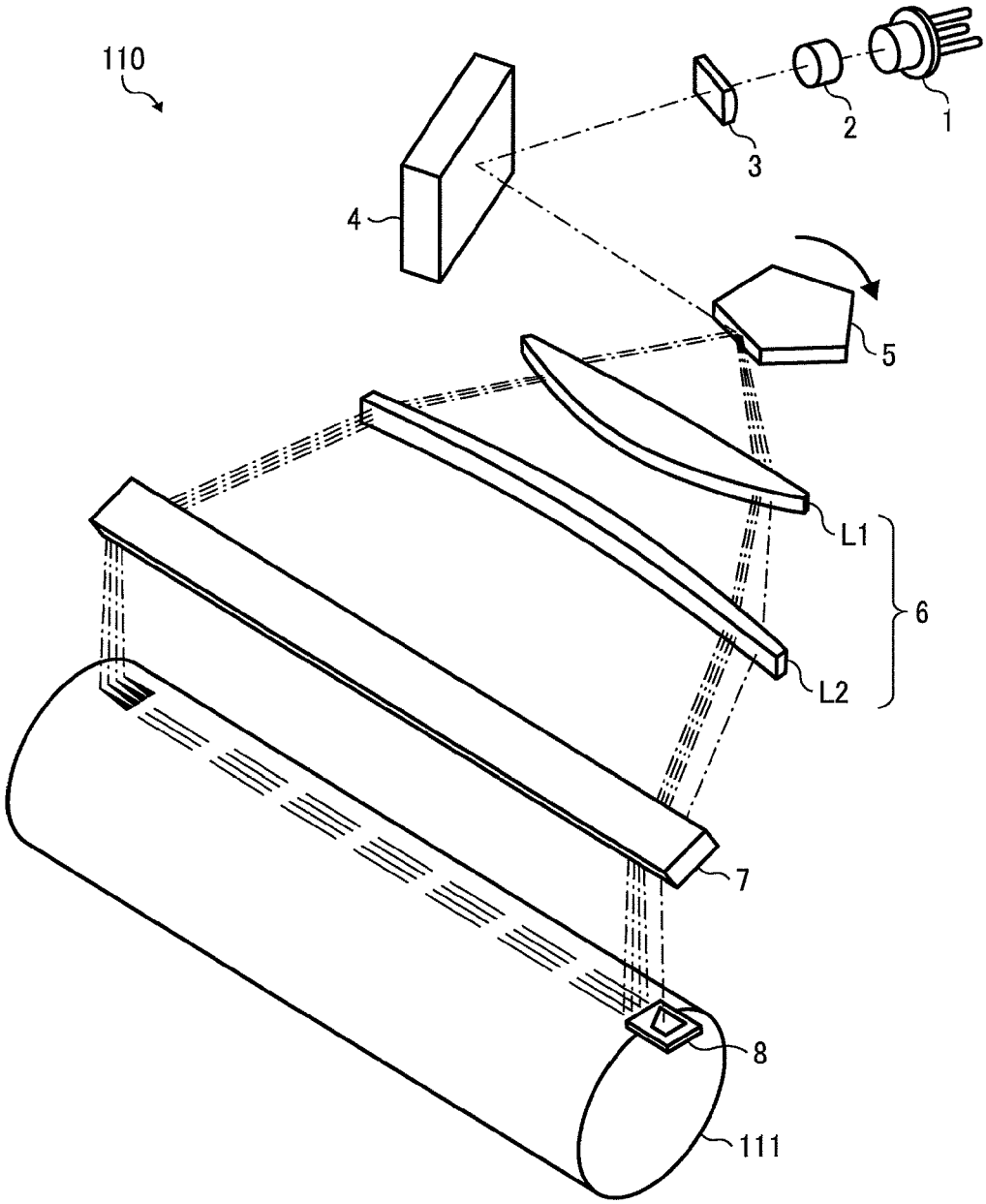
FIGS. 1A to 1C are schematic diagrams for illustration of an embodiment of the present invention and depicting an optical scanning apparatus and a multi-beam light source.
Figure 1B:
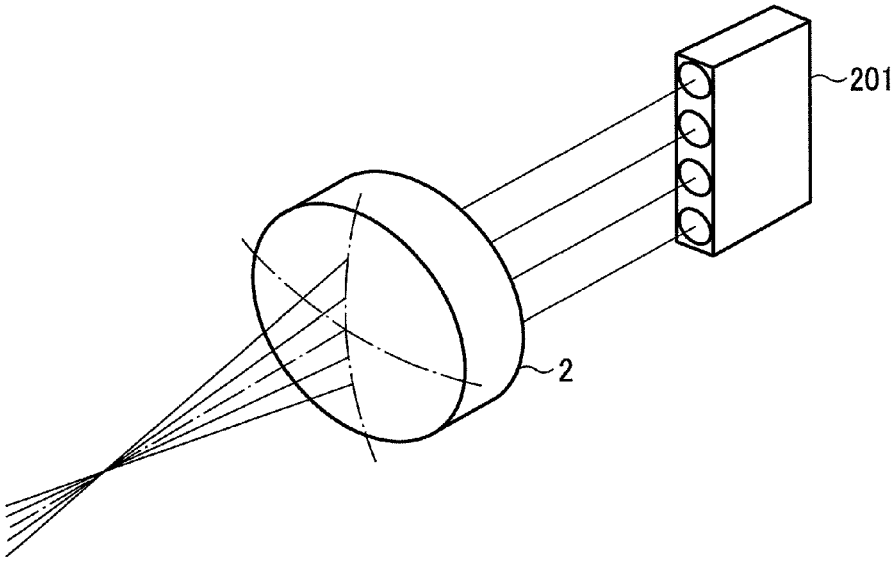
Figure 1C:
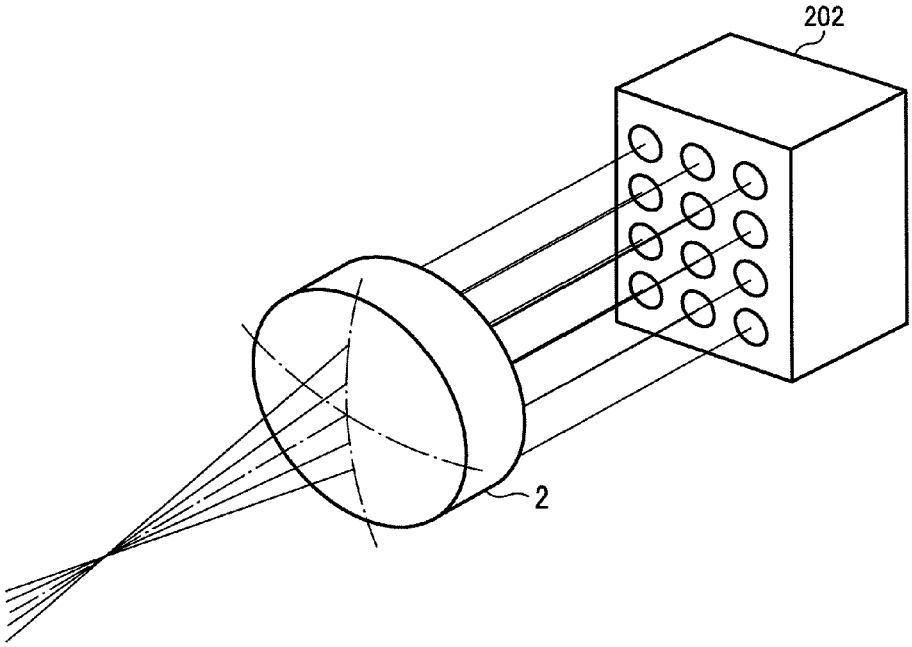

FIGS. 1A to 1C illustrate an example configuration of an optical scanning apparatus and a multi-beam light source according to the first embodiment.

As depicted in FIG. 1A, light beams emitted from a light source unit 1 that includes a semiconductor laser pass through a collimating lens 2 to become substantially collimated beams and then enter a cylindrical lens 3 that serves as a line-image-forming optical system. The cylindrical lens 3 has power only in the sub-scanning direction and causes a plurality of incident light beams to be focused only in the sub-scanning direction and thereafter reflected from a reflecting mirror 4 so as to form a line image that extends in the main-scanning direction near a deflective reflection surface of a polygon mirror 5, which is an optical deflecting unit.

A motor unit that drives the polygon mirror 5 and a drive integrated circuit (IC) (not shown) are provided. A desired rotation speed of the motor unit of the polygon mirror 5 is achieved by feeding appropriate clock signals to the drive IC.

When the polygon mirror 5 is rotated by the motor unit at a constant velocity in the direction indicated by the arrow, each of the plurality of light beams reflected from the deflective reflection surface is deflected at a constant angular velocity to become a deflected beam.

Each of the deflected beams that are deflected passes through scanning lenses L1 and L2, which belong to a scanning-and-image-forming optical system 6, and is reflected from a reflecting mirror 7, which is an elongated flat-surface mirror, so as to have a bent optical path and is condensed by the function of the scanning lenses L1 and L2 into a light spot on a latent image carrier 111 that includes a to-be-scanned surface. Reference numeral 8 indicates a synchronization detector that detects the light beams deflected from the polygon mirror 5.

As depicted in FIG. 1A, a plurality of lines on the to-be-scanned surface are scanned simultaneously with the light deflected from a single reflection surface of the polygon mirror 5.

Print data of one line associated with light-emitting points is stored in a buffer memory in an image processing apparatus (not shown) that controls light-emission signals for the light-emitting points. The print data is read out from the buffer memory on a deflective-reflection-surface-by-deflective-reflection-surface basis of the polygon mirror 5. A light beam flashes on and off on a scanning line on the latent image carrier 111 according to the print data so that an electrostatic latent image is formed with scanning lines.

FIG. 1B illustrates an example configuration that employs, as an example of a multi-beam light source for use in the light source unit 1 illustrated in FIG. 1A, a semiconductor laser array (laser diode array (LDA)) 201 that includes four semiconductor lasers (LDs) arranged in a line extending in the sub-scanning direction as light sources. The LDA 201 is oriented to be orthogonal to the optical axis of the collimating lens 2.

The latent image carrier 111 can be a photoconductive photosensitive member, for example.

Figure 2:
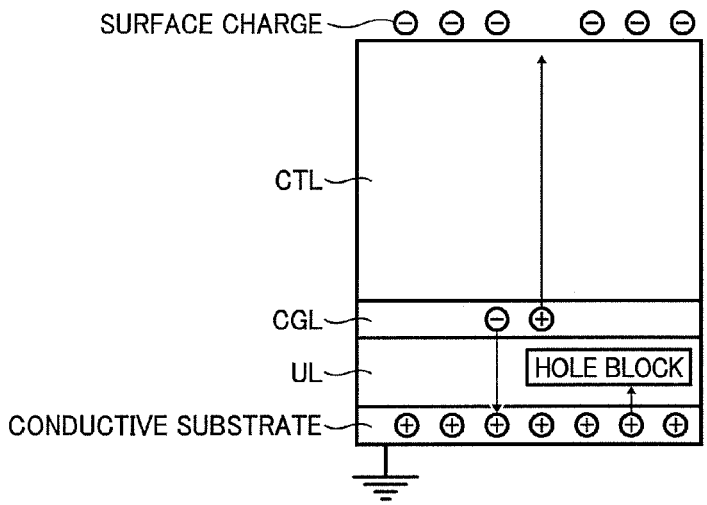
FIG. 2 is a schematic cross-sectional view of a relevant portion of an example configuration of a photosensitive member for use in forming a latent image.

As schematically depicted in FIG. 2, an organic photoconductor (OPC) is constructed by laminating an under coat layer (UL), a charge generation layer (CGL), and a charge transport layer (CTL) on a conductive substrate. When light is irradiated onto the OPC whose surface charges are bearing electrical charges for exposure, the light is absorbed by charge generation material (CGM), which in turn generates charge carriers of both polarities; i.e., positive charge carriers and negative charge carriers. With application of an electric field, the carriers charged to one of the polarities are injected into the CTL while the carriers charged to the other one of the polarities are injected into the conductive substrate. The carriers injected into the CTL are swept by the electric field to reach a surface of the CTL, where the carriers combine with charges on a surface of the photosensitive member and dissipate. Electric charge distribution is thus formed on the surface of the photosensitive member. Put another way, an electrostatic latent image is formed. The CTL includes charge transport material (CTM) for use in transporting carriers to the surface. Transport capability of the CTM varies depending on a material of the CTM.

The UL provides functions of preventing injection of charges from the conductive substrate and the like.

The configuration is not limited thereto, and a photosensitive member, in which the CTL and the CGL are transposed, or a single-layer photosensitive member, in which charge generation material and charge transport material are mixed together, can be used.

In a situation where reciprocity law is valid, the following relationship exists:

exposure energy density=(light quantity per unit area of image surface)×(exposure time). Therefore, electrostatic latent image will not vary so long as the exposure energy density is constant.

However, in a situation where a reciprocity law failure phenomenon occurs, even if the exposure energy density obtained as (light quantity per unit area of image surface)×(exposure time) is constant, a latent image diameter and a latent image depth can vary greatly under a condition where exposure duration is long.

This is because when light quantity is large, the number of carriers that recombine increases and hence the number of carriers that reach the surface decreases.

Therefore, when exposure is performed with a plurality of light beams, the reciprocity law failure phenomenon becomes pronounced.

Inventors of the present invention have developed an apparatus that quantitatively measures an electrostatic latent image on a photosensitive member on the order of micrometers, which has conventionally been difficult.

Figure 3:
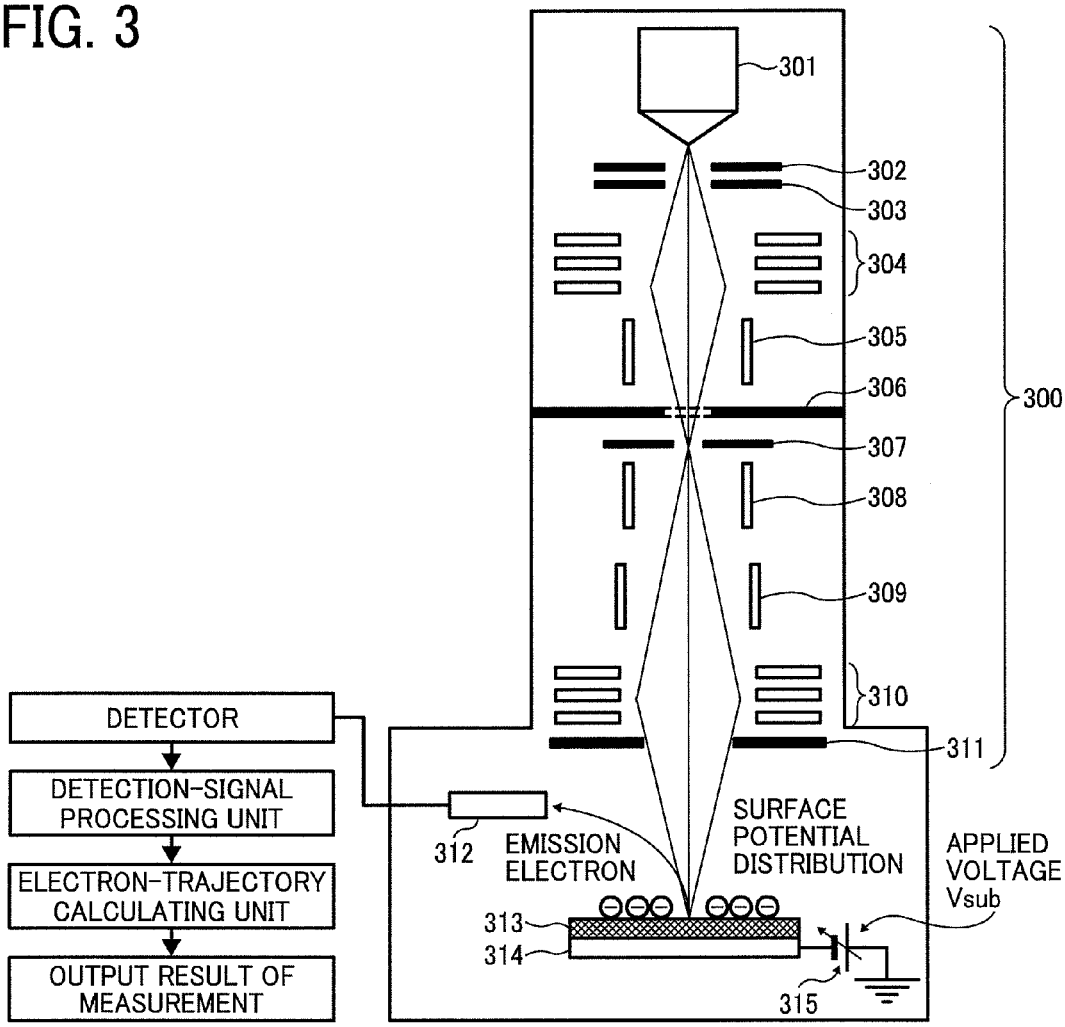
FIG. 3 is a schematic diagram illustrating an example configuration of an electrostatic-latent-image measurement apparatus and a case example of measurement.

FIG. 3 illustrates an example configuration of the apparatus that measures an electrostatic latent image and a case example of measurement.

This measuring apparatus includes an electrically charged particle irradiating unit that irradiates electrically charged particles, an exposure unit, a sample mount unit, and a detecting unit that detects primary reverse charged particles, secondary electrons, and the like.

The charged particles hereinafter denote particles, such as electron beams or ion beams, that can be influenced by an electric field or a magnetic field.

An example of emitting an electron beam will be described below.

An electron-beam emitting unit of the measuring apparatus depicted in FIG. 3 includes a charged-particle optical system 300. The charged-particle optical system 300 includes an electron gun 301 for generating an electron beam, an extractor (a suppressor electrode and an extracting electrode) 302 for controlling the electron beam, an accelerating electrode 303 for controlling energy of the electron beam, a condenser lens (an electrostatic lens) 304 for causing the electron beam emitted from the electron gun 301 to converge, a beam blanking electrode (a beam blanker) 305 for turning the electron beam on/off, apertures (a partitioning valve 306 and a movable diaphragm 307) for controlling electron-beam-emission electric current, a stigmator 308 for correcting astigmatism, a scanning lens (a deflecting coil) 309 for causing the electron beam passed through the beam blanker 305 and the apertures (the partitioning valve 306 and the movable diaphragm 307) to scan, an objective lens (an electrostatic lens) 310 for causing the electron beam passed through the scanning lens 309 to converge again, and a beam emission opening 311. Each of the lenses and the like is connected to a power supply (not shown) that drives the lens or the like.

If an ion beam is to be emitted, a liquid metal ion gun or the like is employed in place of the electron gun.

A scintillator or a photomultiplier tube is used as a unit (detector) 312 for detecting a primary reverse electron.

A photosensitive member sample 313, which is a measurement subject, is placed on a sample mount unit 314 that includes a conductor. The sample mount unit 314 is configured to receive, at the conductor, a voltage Vsub applied from a voltage applying unit 315.

An example flowchart for signal processing for the measurement is given on the left-hand side of FIG. 3. A signal detected by the detector 312 is processed by a detection-signal processing unit. A trajectory of an electron is calculated by the electron-trajectory calculating unit. A result of measurement is output.

Figure 4A:
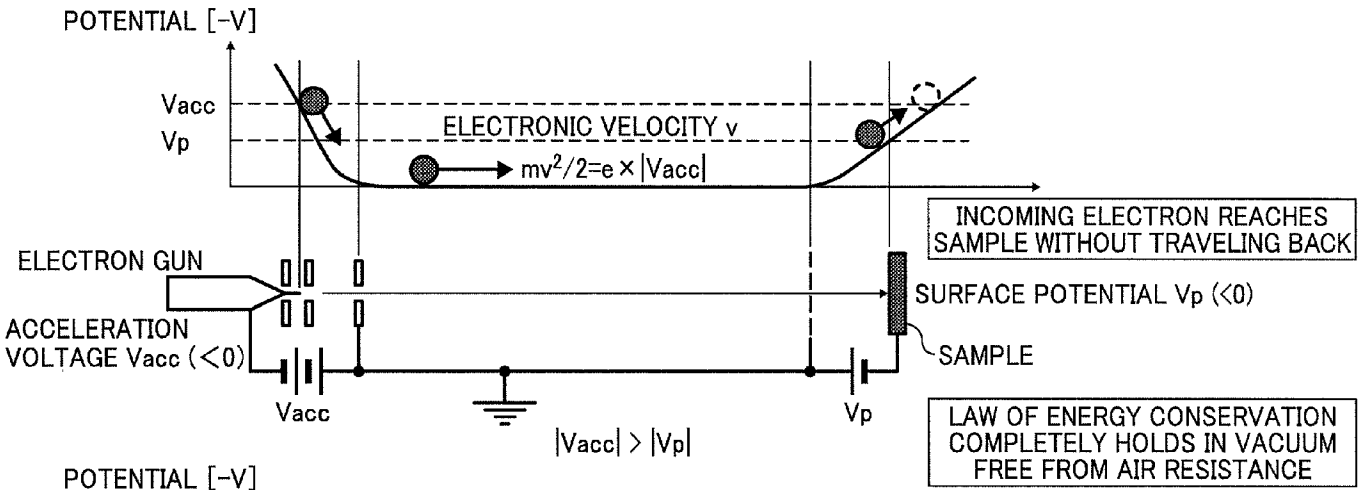
FIGS. 4A and 4B are schematic explanatory diagrams each illustrating a relationship between an incoming electron and a sample.
Figure 4B:
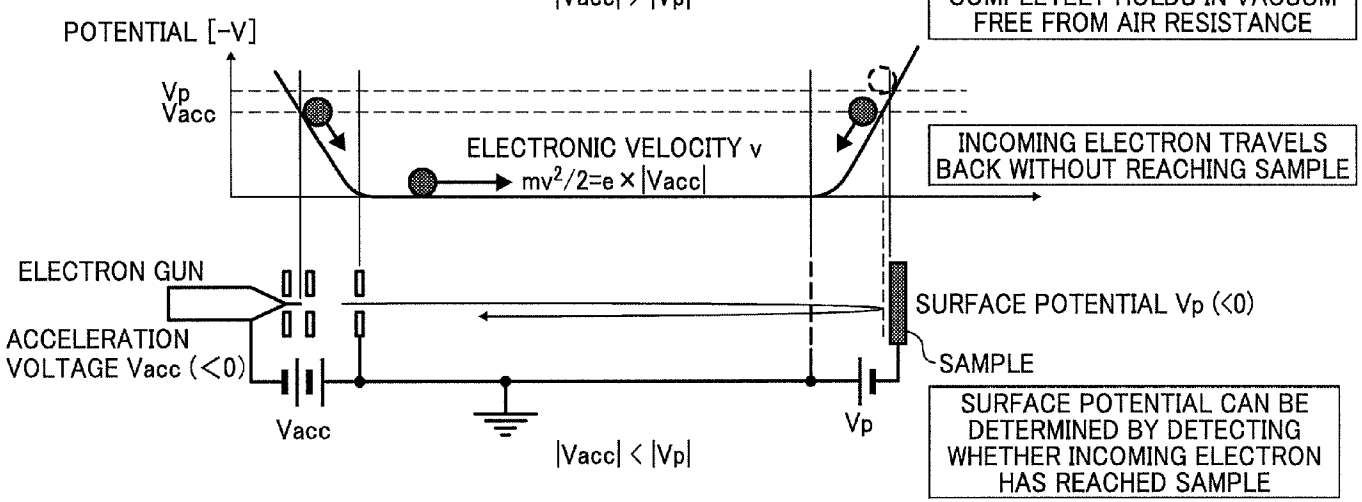

FIGS. 4A and 4B are explanatory diagrams each illustrating a relationship between an incoming electron and a sample.

There is employed such a configuration, in which a primary incoming charged particle is detected by utilizing a fact that there is an area where the velocity vector of an incoming charged particle relative to the direction orthogonal to a sample can be reversed before the charged particle reaches the sample.

Meanwhile, an acceleration voltage is generally expressed as a positive value; however, a voltage Vacc applied as the acceleration voltage is negative. For clarity of physical description in terms of electric potential, the acceleration voltage is expressed as a negative value (Vacc<0) hereinafter.

An acceleration electric potential of an electron beam is designated by Vacc (<0) while electric potential of a sample is designated by Vp (<0).

Meanwhile, an electric potential is electrical potential energy of a unit charge. Hence, although an incoming electron moves, at an electric potential of 0 (V), at a velocity corresponding to the acceleration voltage Vacc, the electric potential of the electron increases as the electron approaches a surface of the sample, causing the velocity of the electron to change under influence of electrostaticrepulsion exerted by charges of the sample.

Accordingly, there is generally exhibited the following phenomenon.

Referring to FIG. 4A, when |Vacc|>|Vp| holds, although the velocity of an electron is decreased, the electron reaches the sample.

In contrast, referring to FIG. 4B, when |Vacc|<Vp| holds, the velocity of an incoming electron gradually is decreased under influence of an electric potential of the sample and reaches zero before the electron reaches the sample; thereafter, the electron travels in the opposite direction.

In a vacuum free from air resistance, the law of energy conservation substantially completely holds. An electric potential of an incoming electron on a surface of a sample can be determined by setting energy of the incoming electron to various values and determining a condition where the energy on the surface, or landing energy, becomes substantially zero. Hereinafter, a primary reverse charged particle, particularly a primary reverse charged electron, is referred to as a primary reverse electron. Because the number of secondary electrons, which are emitted when electrons reach the sample, that reach the detector 312 greatly differs from the number of primary reverse charged electrons that reach the detector 312, distinction therebetween can be made based on a boundary of contrast of light and dark.

Meanwhile, a scanning electron microscope or the like typically includes a backscattered electron detector. A backscattered electron to be detected by the detector generally denotes a landing electron that strikes a sample and is emitted from a surface of the sample by being reflected (scattered) backward by interaction between the electron and material of the sample. Energy of the backscattered electron is equivalent to energy of the landing electron. It is assumed that the intensity of a backscattered electron increases as the atomic number of the sample increases. This detection method is used to discern compositions and detecting pits and projections of a sample.

In contrast, a primary reverse electron is an electron of which traveling direction is reversed before reaching a surface of a sample under influence of potential distribution on the surface of the sample, and related to a quite different phenomenon.

Figure 5A:
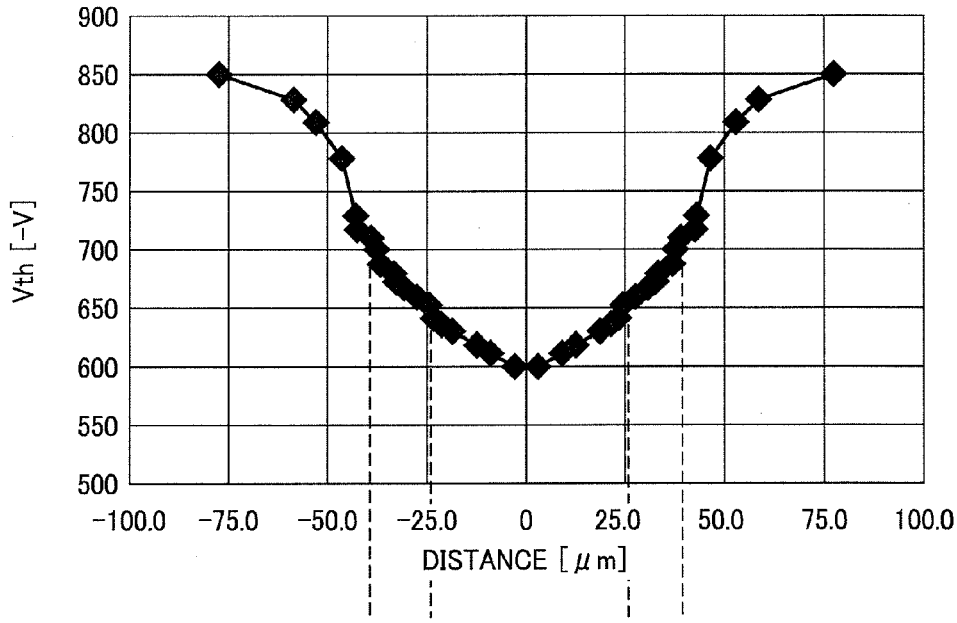
FIGS. 5A to 5C are schematic diagrams illustrating example results of measurement of latent image depth.
Figure 5B:
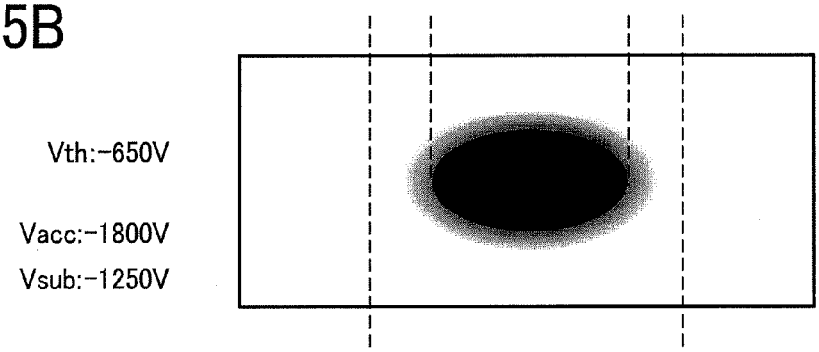
Figure 5C:
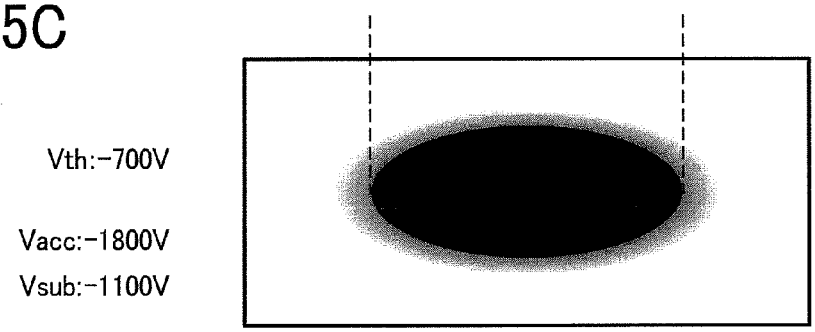
Figure 6:
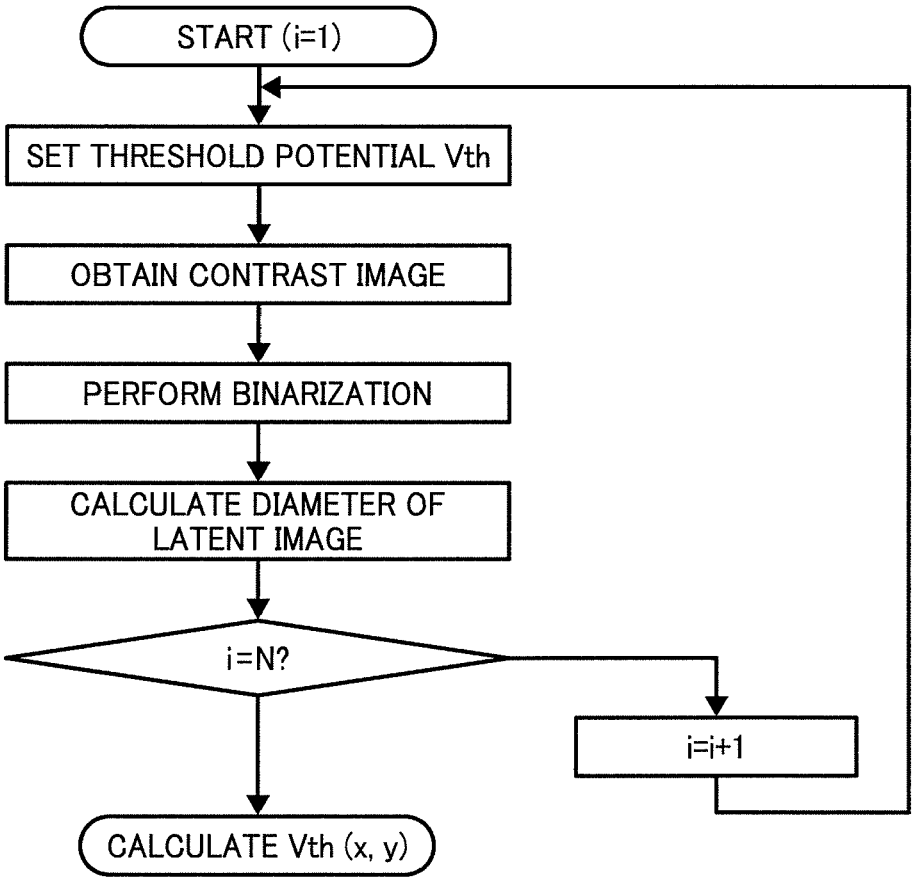
FIG. 6 is a flowchart illustrating a process procedure for measurement of latent image depth.

FIGS. 5A to 5C are diagrams illustrating example results of measurement of the latent image depth. FIG. 6 is a flowchart of a process procedure for measuring the latent image depth.

When the difference between an acceleration voltage Vacc and an applied voltage Vsub, which is imposed on a bottom of a sample, is denoted by Vth(=Vacc−Vsub), potential distribution V(x, y) can be determined by finding Vth (x, y) where landing energy is substantially zero by taking the difference at each scanning position (x, y). Vth (x, y) and potential distribution V(x, y) is in one-to-one correspondence with each other. Hence, when Vth (x, y) has smooth charge distribution or the like, Vth (x, y) is approximately equivalent to potential distribution V(x, y).

The curve given in FIG. 5A illustrates an example surface potential distribution produced by electrical charge distribution on a surface of a sample. An acceleration voltage Vacc for an electron gun that performs two-dimensional scanning is set to −1800 volts. An electric potential at the center (where coordinate on the horizontal axis is 0) is approximately −600 volts. The electric potential increases in the negative direction away from the center and reaches approximately −830 volts at a peripheral area where a diameter from the center is greater than 75 micrometers. The oval shape in FIG. 5B is an image obtained by imaging outputs of a detector in response to detection with Vsub for the backside of a sample set to −1150 volts. Under this condition, Vth=Vacc−Vsub=−650 volts holds. The oval shape in FIG. 5C is an image obtained by imaging outputs of a detector under the same condition as that mentioned above but with Vsub set to −1100 volts. Under this condition, Vth is −700 volts.

Therefore, information about potential on a surface of a sample can be obtained by determining distribution of Vth by scanning the surface of the sample with electrons with varying the acceleration voltage Vacc or the applied voltage Vsub.

Use of this method makes it possible to visualize a latent image profile on the order of micrometers, which has conventionally been difficult.

Figure 7:
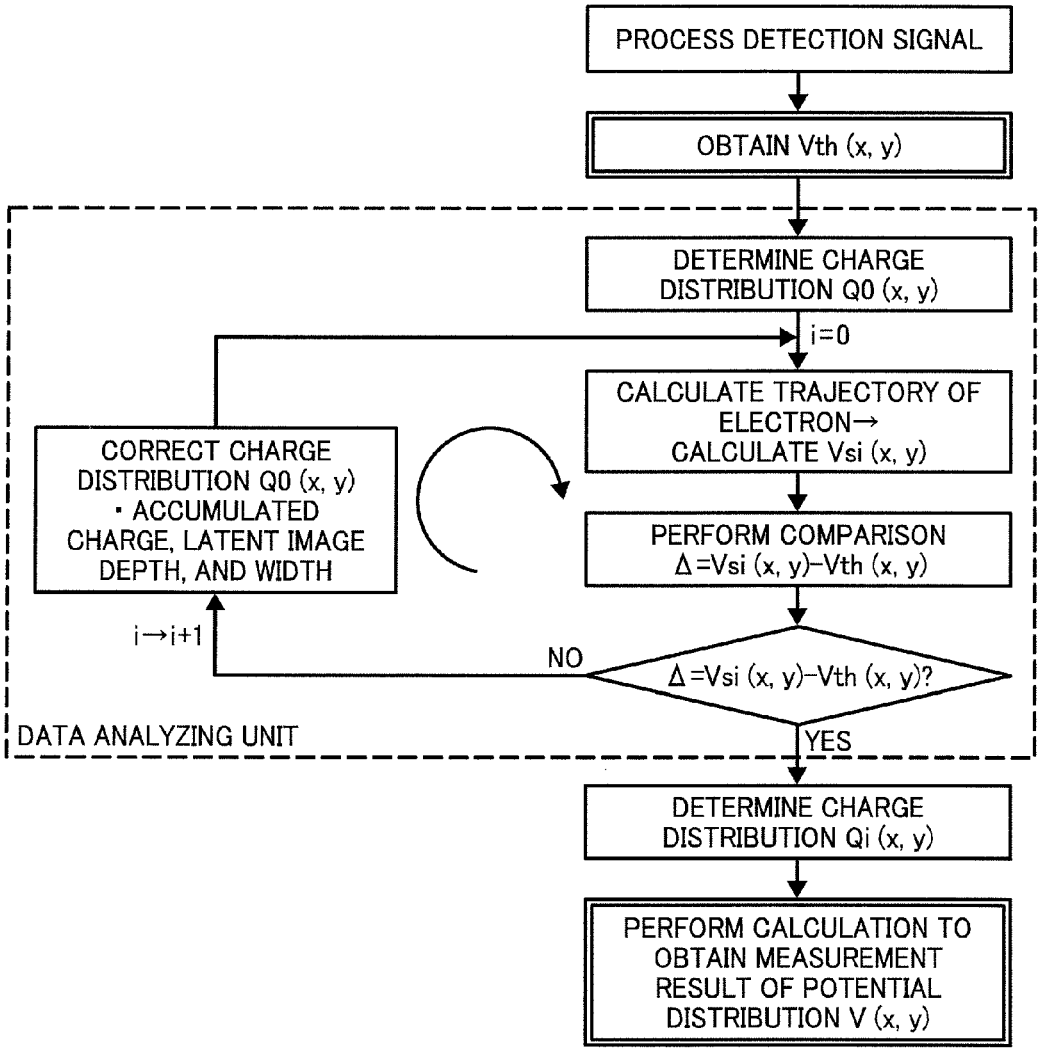
FIG. 7 is a flowchart illustrating an example method for correcting a distribution model of charges or potentials for determining surface potential distribution.

FIG. 7 is a flowchart illustrating an analysis procedure for calculating a measurement result of potential distribution based on charge distribution correction. Potential distribution can be measured further accurately by employing a method of, as in the flowchart given in FIG. 7, modeling distribution of charges or potentials of a sample in advance, calculating a trajectory of an electron beam, and correcting a distribution model of charges or potentials for determining surface potential distribution based on the electron beam trajectory.

Figure 8A:
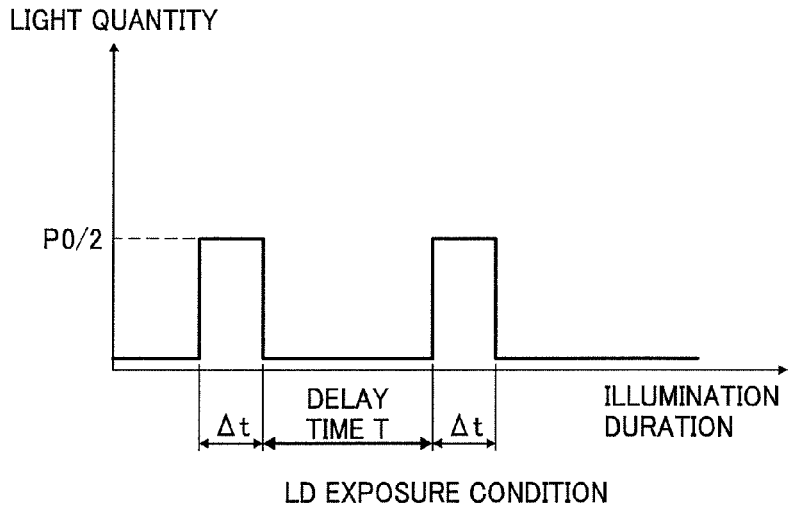
FIGS. 8A and 8B are graphs illustrating a relationship between delay time and latent image depth.
Figure 8B:
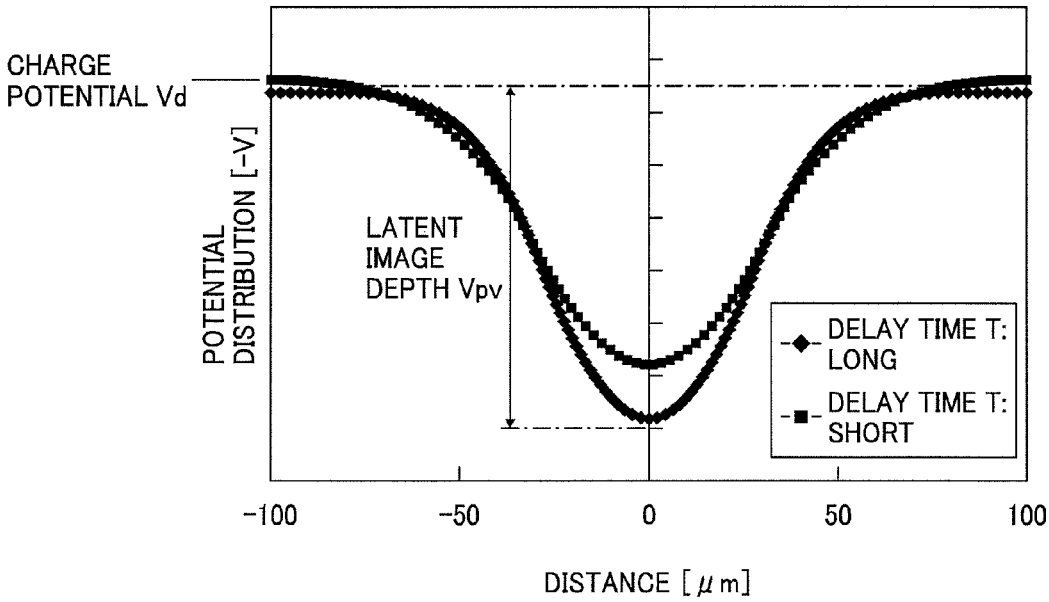

Latent-image potential depth Vpv is measured with varying delay time T, which corresponds to scanning cycle, under a condition where exposure energy density is kept constant; i.e., illumination light quantity and illumination duration are kept constant as depicted in FIG. 8A, by using such measurement means as mentioned above. A result of this measurement depicted in FIG. 8B indicates that the longer the delay time, the deeper the potential depth Vpv is likely to become, and that when the delay time is plotted on a logarithmic scale as depicted in FIG. 9A, the potential depth Vpv changes along a substantially sigmoid curve.

Figure 9A:
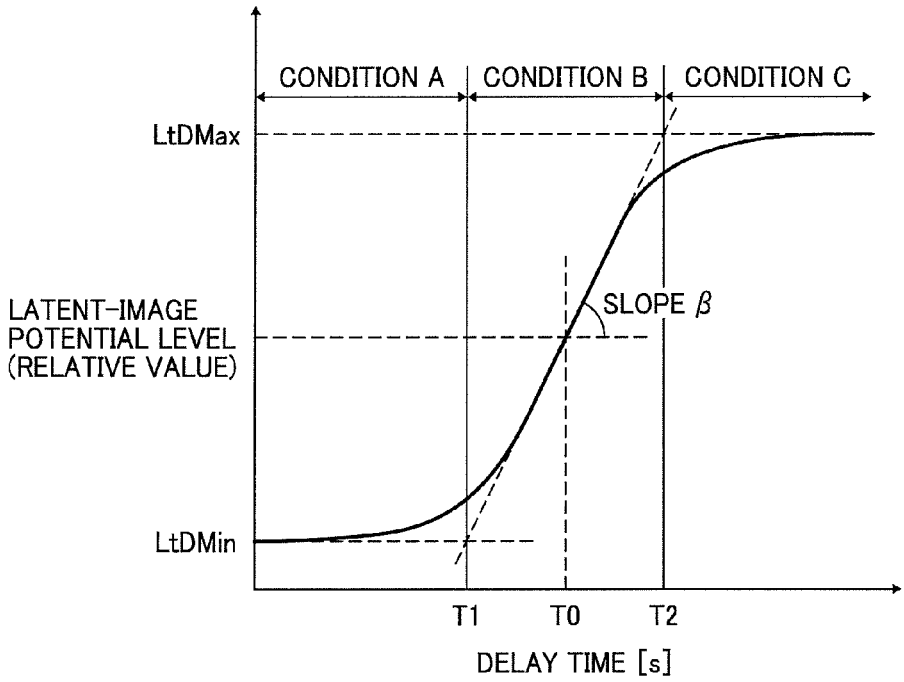
FIGS. 9A and 9B are schematic explanatory diagrams of a mechanism of delay time characteristics and delay time characteristics.
Figure 9B:
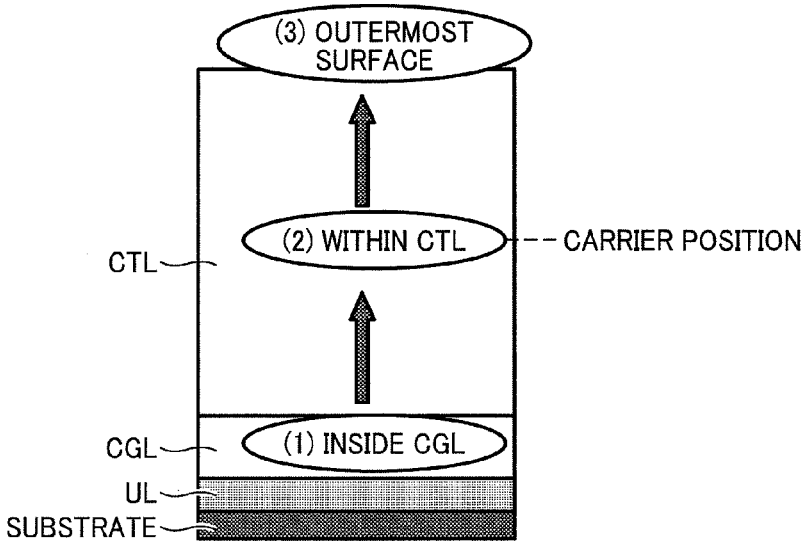

A phenomenon, in which a latent-image potential depth changes along a substantially sigmoid curve with respect to the delay time as illustrated in FIG. 9A, depends on, when the phenomenon occurs at a second exposure, a position of a carrier at a first exposure as illustrated in FIG. 9B.

In a transit-in-CGL period, both of a carrier generated by the first exposure and that generated by the second exposure coexist inside the CGL; therefore, condition for recombination is kept approximately constant independent of time. This is referred to as a condition A.

In a range of delay time in the transit-in-CGL period, a latent image is formed deeper as time elapses. This is because the electric field intensity of the CGL changes at the position of the carrier of the first exposure, and hence quantum efficiency; i.e., the number of generated carriers, at the second exposure is changed. This is referred to as a condition B.

In a range where delay time is long, a carrier reaches the outermost surface, at which the position of the carrier is fixed; therefore, the number of generated carriers and the number of recombined carriers do not change, and the depth of a latent image potential is kept constant. This is referred to as a condition C.

Accordingly, mobility of a generated carrier can be measured by measuring latent-image potential depths with varying delay time.

The mobility can be measured with a time-of-flight (TOE) method or the like; however, measurement of a layer structure photosensitive member that includes an UL and a CGL is theoretically difficult. Even when the mobility can be measured, it can be further difficult to determine actual transit time.

In contrast, the present measuring method allows measurement of a layer-structure photosensitive member that includes an UL and a CGL and can be considered to be faithful to an actual latent-image forming process.

To be more specific, the conditions A, B, and C are explicitly defined as follows:

condition A: $T \leqq T1$ condition B: $T1 < T < T2$ condition C: $T > T2$ where TI is an intersection between a tangent of the latent-image potential depth curve, which is referred to as the sigmoid curve and in which the delay time is plotted on the logarithmic scale, at an inflection point and LtDMin, T2 is an intersection between the tangent and LtdMax, and T is delay time.

Each of the condition A and the condition C is assumed as a condition where carriers substantially stay still in the charge transport layer while the condition B is assumed as a condition where carriers are drifting in the charge transport layer toward the surface of the photosensitive member.

More strictly, even in the condition A and condition C, carriers are drifting only by little; however, because the drifting motion is considerably slow as compared with that in the condition B, this is defined as a condition where carriers substantially stay still in the charge transport layer.

In the condition B, the latent image depth varies depending on the delay time. In other words, image density varies.

Accordingly, when a latent image is formed at a scanning cycle (=1/(scanning frequency)) in the range of this condition, image density is likely to vary greatly.

By performing exposure in other than in this range but in the condition A or the condition C, a state of a latent image is prevented from varying even when the latent image is formed by multiple-surface scanning. Put another way, occurrence of reciprocity law failure is substantially prevented, whereby uniform image density is attained stably.

Figure 19:
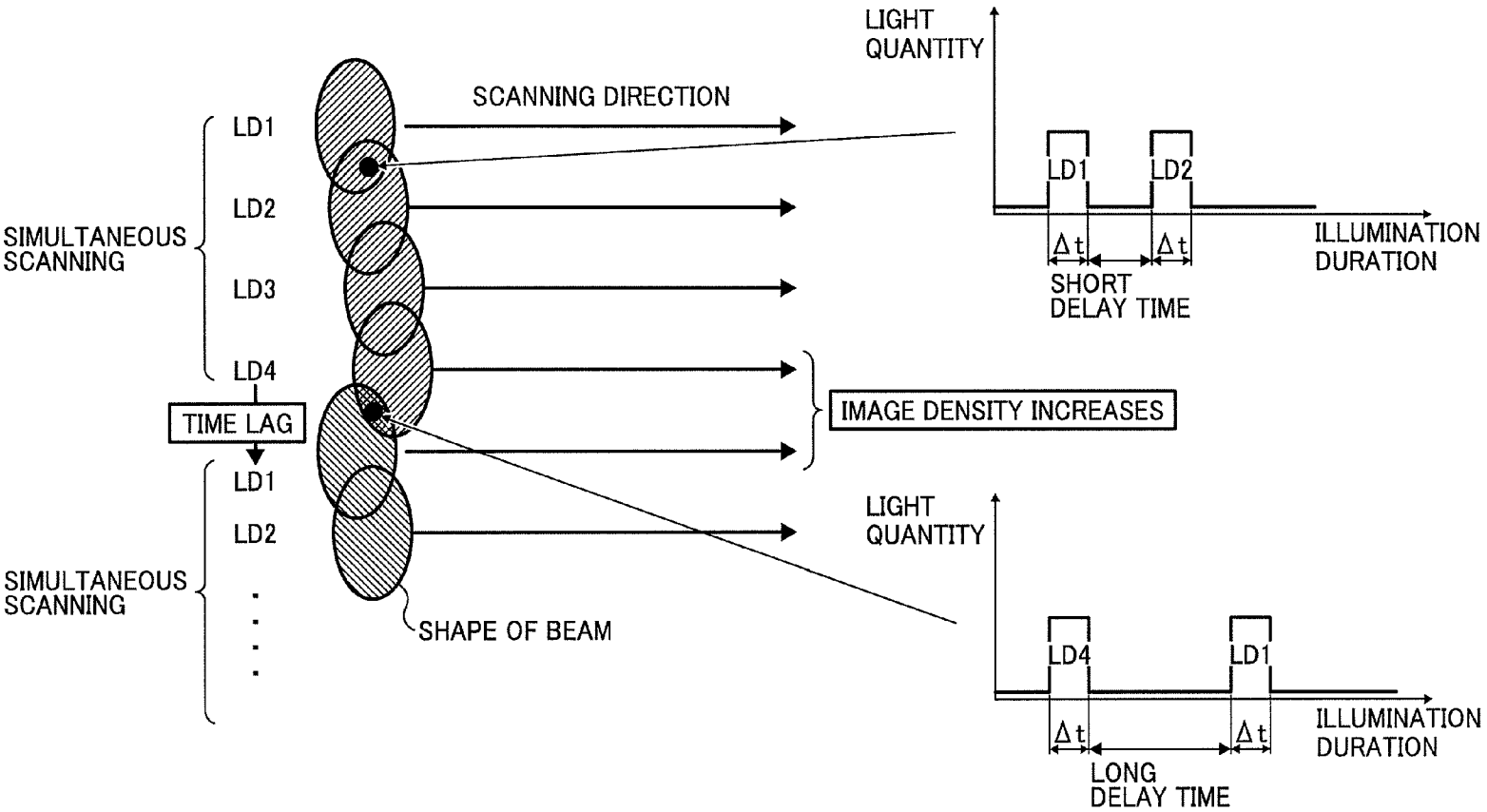
FIG. 19 is an explanatory diagram of light-emission timing of an example configuration where a 4-channel laser diode array (4ch-LDA) is used as a scanning optical system of an image forming apparatus and disadvantage pertaining thereto.

The phenomenon where image density increases, which has been mentioned with reference to FIG. 19, will be described in view of the conditions A to C.

This phenomenon is caused because there are an area on which one-surface exposure is performed and an area on which two-surface exposure is performed, and delay time produced by the two-surface exposure is in the range of the condition B.

In the condition B, a value of a latent image depth varies in response to a slight shift of timing, and even when timing is constant, mobility of a photosensitive member is likely to vary, which results in variation in latent image depth.

Therefore, it is desirable to perform exposure in a condition, such as the condition A or the condition C, where carriers substantially stay still.

A second embodiment of the present invention will be described below.

Figure 10:
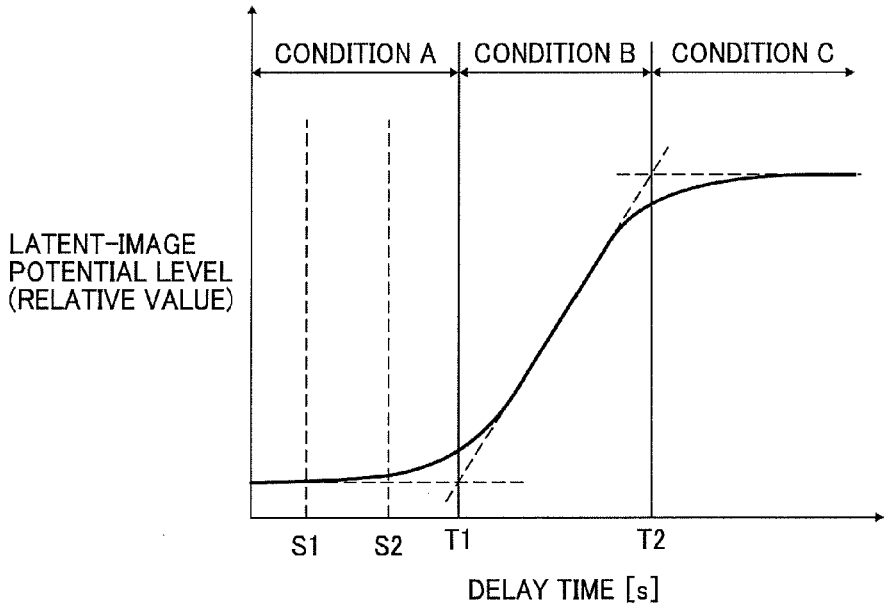
FIG. 10 is a plot illustrating a relationship between delay time and latent image depth.

FIG. 10 illustrates a relationship between exposure timing and delay time. S1 denotes delay time produced by one-surface exposure and S2 denotes delay time produced by two-surface exposure. In some cases of one-surface exposure, exposure is performed simultaneously, while in other cases of one-surface exposure where light sources have incident angles that slightly differ from each other relative to an optical deflector, delay time of approximately several micrometers can be produced; nevertheless, this is applicable to either case.

Accordingly, to prevent uneven image density while employing a method of attaining a required exposure by performing one-surface exposure at minimum, the same state as that of the one-surface exposure is desirably attained even by two-surface exposure. Put another way, delay time that corresponds to a scanning cycle of the optical deflector is desirably in the range of the condition A.

In other words, the optical deflector is desirably driven so as to satisfy:

$$f \geqq 1/T1$$

because a scanning cycle T of an optical deflector, of which single scanning frequency is f(Hz), is expressed as 1/f.

From the viewpoint of a charge transport material, a material that provides relatively long actual transit time is desirably employed. A look from the reverse angle can also be taken. For example, it is derived that when drive frequency is set to 5 kHz, actual transit time is desirably 200 μs or longer.

The scanning frequency is desirably high to produce the condition A. Employment of a charge transport material that provides transit time that is long but shorter than a period that inversely affects process speed leads to expansion of usable range of the scanning frequency.

Put another way, optimum condition for charge mobility is desirably determined by taking scanning time and exposure condition into consideration rather than placing importance only on high mobility.

Meanwhile, in a case where scanning frequency is fixed, a photosensitive member that contains charge transport material that provides optimum transit time against the conditions mentioned above can be selected.

A third embodiment of the present invention will be described below.

Figure 12A:
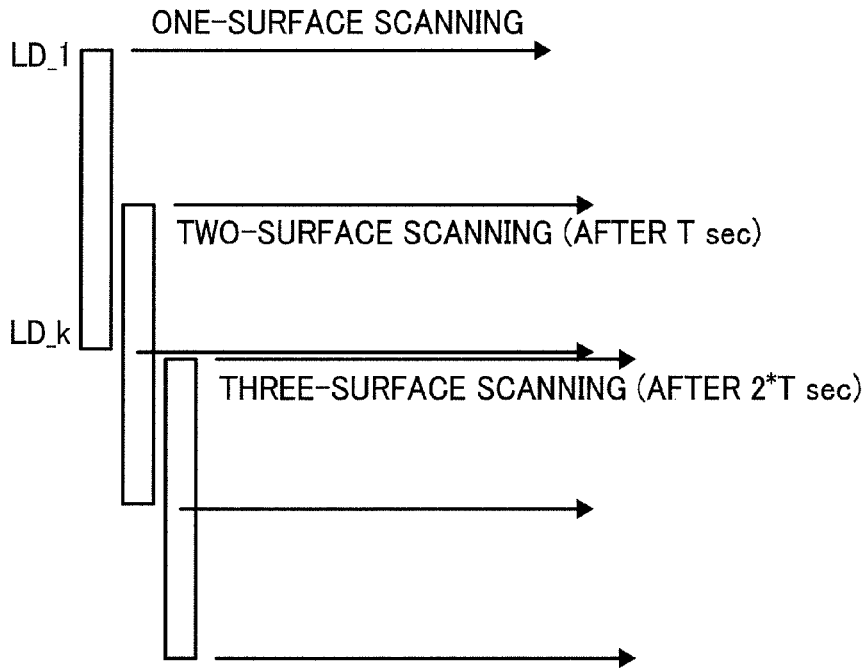
FIGS. 12A and 12B are schematic explanatory diagrams of multiple exposures performed by multiple-surface scanning.

FIG. 12A illustrates a multiple-exposure method of attaining a required exposure by performing two-surface scanning at minimum. There are provided k LDs, or light sources, that are vertically arranged to perform scanning at scanning frequency f (Hz), which corresponds to scanning cycle T (s) when converted into a period of time. After T (s), a position has proceeded by a distance of a half of an image-surface pitch of a range between a first LD and a kth LD in the sub-scanning direction. With this method, a required exposure is not attained only by single stroke of scanning. Therefore, scanning is to be performed at least two times; in other words, two-surface scanning is to be performed. A boundary area between one-surface scanning and three-surface scanning can be illuminated by three surf aces.

More specifically, there are an area where exposure is accomplished by performing scanning two times and an area where exposure is accomplished by performing scanning three times.

Under such a condition, even when an integral of light quantity at different areas is fixed, latent image depth undesirably can vary as mentioned above.

Figure 11:
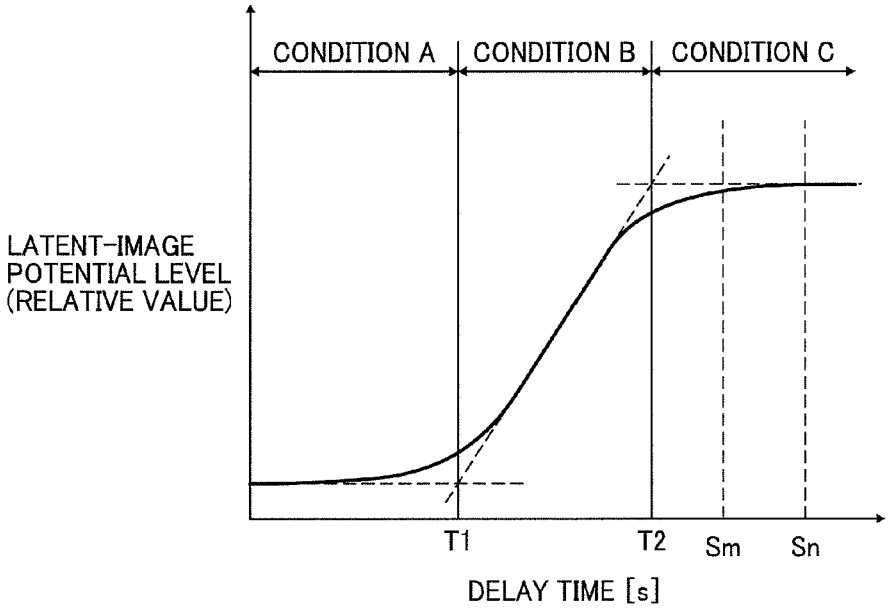
FIG. 11 is a plot illustrating a relationship between delay time and latent image depth.

With such a method, scanning frequency for the condition C is desirably set as illustrated in FIG. 11.

Sm denotes scanning time for one-to-m surfaces and Sn denotes scanning time for one-to-n surfaces.

Generally, the following equation holds.

$$n=m+1$$

However, in a case where a beam diameter is sufficiently large as compared to the pitch, the following expression can hold.

$$n>m+1$$

With these taken into consideration, the following expression is desirable satisfied.

$$f \leqq 1/T2$$

Figure 12B:
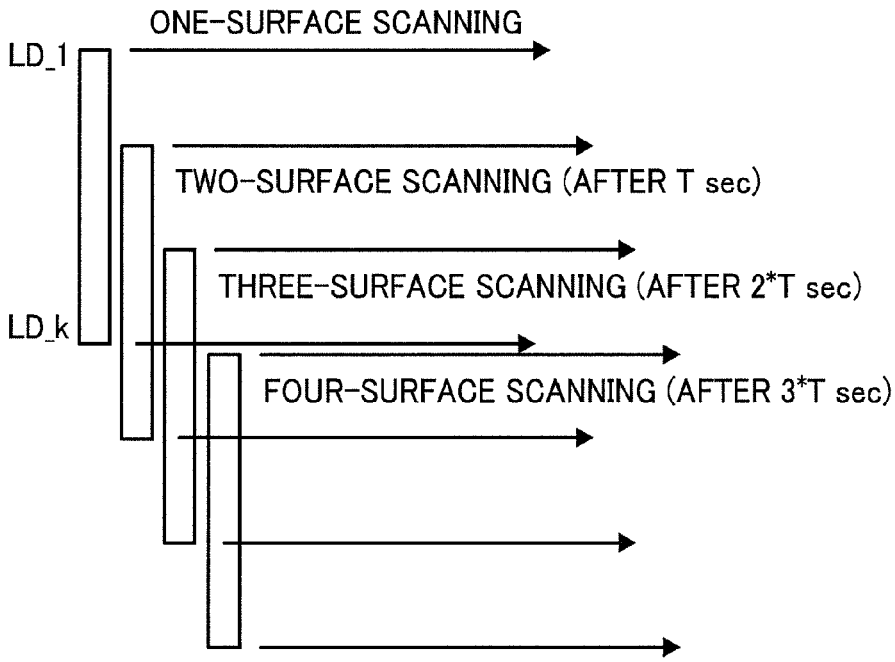

Similarly, when such a multiple-exposure method as illustrated in FIG. 12B of attaining a required exposure by performing three-surface scanning is employed, the following expression is desirably satisfied.

$$f \leqq 2/T2$$

In more general of terms, when a multiple-exposure method of attaining a required exposure by performing msurface scanning at minimum is employed, the following expression is desirably satisfied.

$$f \leqq (m-1)/T2$$

To produce the condition C, it is desirable to use a charge transport material that provides short actual transit time for reaching a surface or to employ low scanning frequency.

Note that m is not necessarily an integer. Note that scanning is not necessarily performed with a method of exposing a fixed position but an interlaced scanning method of exposing between beams can be employed.

A fourth embodiment of the present invention will be described below. The fourth embodiment is featured by the configuration in which the optical scanning apparatus discussed above includes a vertical-cavity surface-emitting laser (VCSEL) as the multi-beam light source unit 1.

FIG. 1C illustrates an example configuration of a light source unit of an optical scanning apparatus that includes a VCSEL, of which wavelength is 780 nanometers, of which light emitting points are arranged on a plane extending in the x-axis direction and in the y-axis direction. In this example configuration, a surface emitting laser 202 that includes 12 light-emitting points in an arrangement of 3 rows in the horizontal direction (main-scanning direction) and 4 columns in the vertical direction (sub-scanning directions) is employed. By applying this example configuration to the optical scanning apparatus depicted in FIG. 1A, the optical scanning apparatus is configured so as to scan a single scanning line with three light sources arranged in the horizontal direction, thereby simultaneously scanning four scanning lines in the vertical direction.

Because it is easy to increase the number of light sources in a VCSEL, the number of light emitting points in the horizontal direction and that in the vertical direction are not limited to those of the above example. For example, the number of the light emitting points can be 40. Furthermore, arrangement thereof can be any one of 4 by 10, 8 by 5, and the like. An arrangement of irregular intervals can also be employed.

The wavelength of the light source is not limited to 780 nanometers as well.

Use of VCSEL is advantageous, as compared to a semiconductor laser (LD) array that uses a plurality of edge-emitting-type semiconductor lasers, in that cost per light beam can be decreased with increasing number of light beams to be generated. Because the cavity length of a VCSEL is considerably short, mode hopping is less likely to occur than with an LD array, and it is theoretically possible to construct a VCSEL with which no mode hopping occurs. Hence, degradation in quality of optical scanning due to transition in wavelength can be reduced. In particular, when a VCSEL is used in an optical system that includes a diffractive optical component of which optical property can vary greatly in response to transition in wavelength, the freedom from mode hopping allows to perform highly favorable optical scanning. Meanwhile, when a large number of light sources are arranged, visually detectable unevenness in image density is likely to become pronounced. Therefore, it is effective to employ such a configuration of using a VCSEL as a light source unit as in the present embodiment.

A fifth embodiment of the present invention will be described below.

Figure 13:
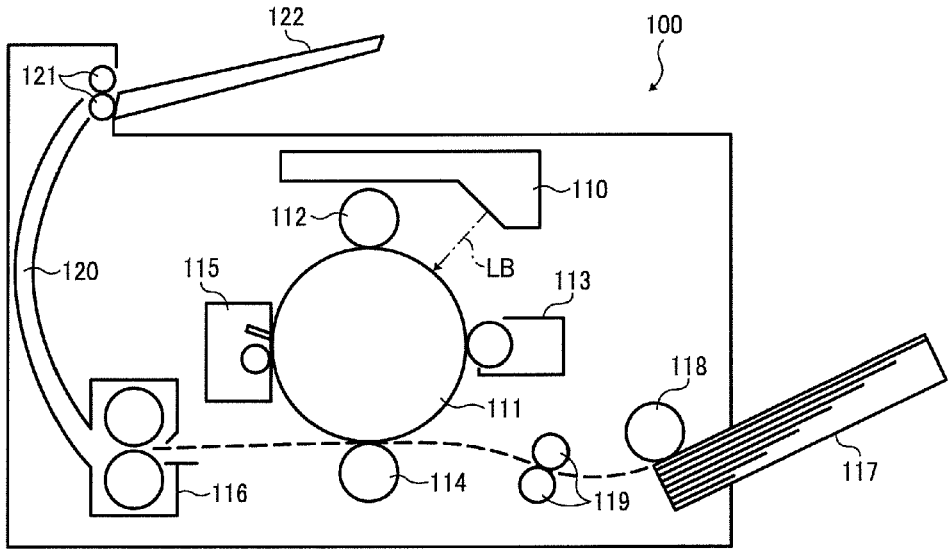
FIG. 13 is a schematic configuration diagram of an image forming apparatus according to an embodiment of the present invention.

FIG. 13 is a schematic configuration diagram of an image forming apparatus according to the fifth embodiment, in which an example laser printer is illustrated. A laser printer 100 depicted in FIG. 13 includes a "photoconductive photosensitive member having a cylindrical form" as the latent image carrier 111. An electrifying roller 112, serving as an electrifying unit, a image developing device 113, a transfer roller 114, and a cleaning device 115 are arranged around the latent image carrier 111. In this embodiment, the electrifying roller 112, which is of a contact type that generates a relatively small amount of ozone, is used as the electrifying unit; however, a corona charger that utilizes corona discharge can alternatively be used as the electrifying unit. The laser printer 100 includes, as a latent-image forming unit, an optical scanning apparatus 110 configured as, for example, illustrated in FIG. 1. The optical scanning apparatus 110 is configured so as to perform "exposure by optical scanning with laser beam LB" at a portion between the electrifying roller 112 and the image development device 113. In FIG. 13, reference numeral 116 denotes a fixing device, 117 denotes a cassette, 118 denotes a sheet feed roller, 119 denotes a pair of registration rollers, 120 denotes a delivery path, 121 denotes a pair of sheet output rollers, and 122 denotes a sheet output tray.

To perform image forming, the latent image carrier 111, which is a photoconductive photosensitive member, is rotated clockwise at constant velocity. The surface of the latent image carrier 111 is electrostatically charged uniformly by the electrifying roller 112. An electrostatic latent image is formed by exposure for optical writing performed by the optical scanning apparatus 110 with the laser beam LB. The thus-formed electrostatic latent image is what is called a "negative latent image" of which image portion is irradiated with light. Reversal development is performed on the electrostatic latent image by the image development device 113 to form a toner image on the latent image carrier 111. The cassette 117 that stores therein transfer paper is detachably attached to a body of the laser printer 100. An uppermost sheet is fed from the transfer paper stored in the cassette 117 mounted as illustrated in FIG. 13 by the sheet feed roller 118. The thus-fed transfer paper is pinched at its leading end portion between the pair of registration rollers 119. The pair of registration rollers 119 delivers the transfer paper to a transfer portion such that the delivery is timed to moving of the toner image on the latent image carrier 111 to a transfer position. The thus-delivered transfer paper is superimposed at the transfer portion by the toner image, which is then electrostatically transferred onto the transfer paper by the transfer roller 114. The transfer paper, onto which the toner image has been transferred, is subjected to toner image fixation performed by the fixing device 116, passes through the delivery path 120 to reach the pair of sheet output rollers 121, by which the transfer paper is delivered onto the sheet output tray 122. After the toner image has been transferred, the surface of the latent image carrier 111 is cleaned by the cleaning device 115 that removes residual toner, paper dusts, and the like from the surface.

The image forming apparatus having such a configuration as mentioned above can be configured into, by using the optical scanning apparatus 110 and the latent image carrier (organic photoconductor) described in the first to fourth embodiment as a latent-image forming unit, an image forming system that causes reciprocity law failure less likely to occur. The image forming apparatus is capable of forming a high-quality image free from uneven image density. Accordingly, there is provided an image forming apparatus that forms a high-resolution, highdefinition image and is highly durable and highly reliable.

Although the example configuration of the laser printer is illustrated in FIG. 13 as an embodiment of the image forming apparatus, the printer can be used as a digital copying machine when a document reading apparatus (scanner), a document feeding apparatus (ADF), and/or like is mounted on the printer. The printer can also be used as a laser facsimile or a digital multifunction product when a communication function and/or the like is further added thereto.

Although FIG. 13 depicts an image forming unit for a single color image, an image forming apparatus capable of forming a multiple-color image or a full-color image can be provided by arranging a plurality of image forming units each including a latent image carrier and components therearound along a conveying direction of transfer paper. The image forming apparatus having such a configuration for forming a multiple-color or full-color image can be configured as a multiple-color image forming apparatus that forms high-resolution, high-definition images and is highly durable and highly reliable by adopting the optical scanning apparatus according to the present invention as a latent-image forming unit.

A sixth embodiment of the present invention will be described below.

The configuration of an image forming apparatus according to the sixth embodiment is similar to that illustrated in FIG. 13 and has already been described in the fifth embodiment.

An example result of measurement carried out by using organic photoconductors (OPCs), serving as the latent image carrier 111, that are identical to each other in the conductive substrate, the UL layer, and the charge generation layer (CTL) but differ from each other in formulation of the charge transport layer (CTL) will be described below.

The CTLs have the same thickness, 35 micrometers; however, a formulation A of one of the CTLs is distilbene compound and a formulation B of the other one the CTLs is stilbene compound.

A distilbene compound has a structure of which conjugated Π system is larger than that of a stilbene compound, and therefore is assumed to have short transit time of carriers to a surface.

Figure 14:
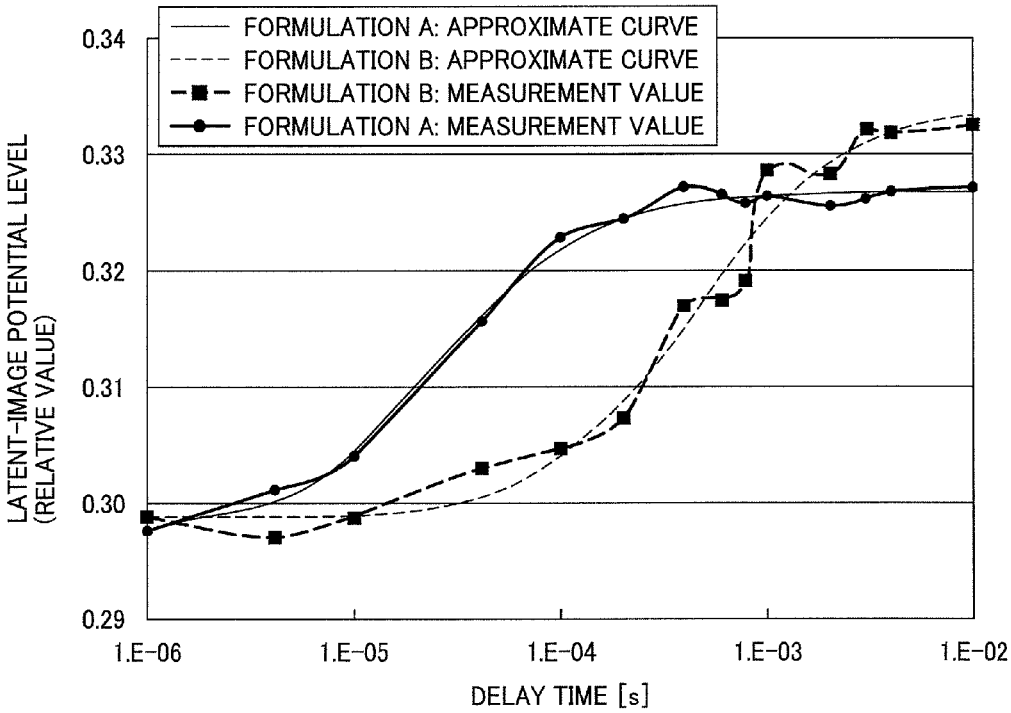
FIG. 14 is a diagram illustrating a relationship between delay time and latent image depth of exposure performed two times with varying delay time.

Listed below are principle latent-image forming conditions.

electric charge condition:

charge potential: −900 V exposure condition:

wavelength: 655 nm beam diameter: 57 μm×83 μm image-surface light quantity: optical output power of intensity with which required exposure energy (4 mJ/m$^2$) attained when exposure is performed two times Measurement results of exposure that is performed two times with varying delay time are plotted in FIG. 14. Measurement values of the formulations A and B, which are given in FIG. 14, represented in the form of approximate curves are given in FIG. 15.

Figure 16A:
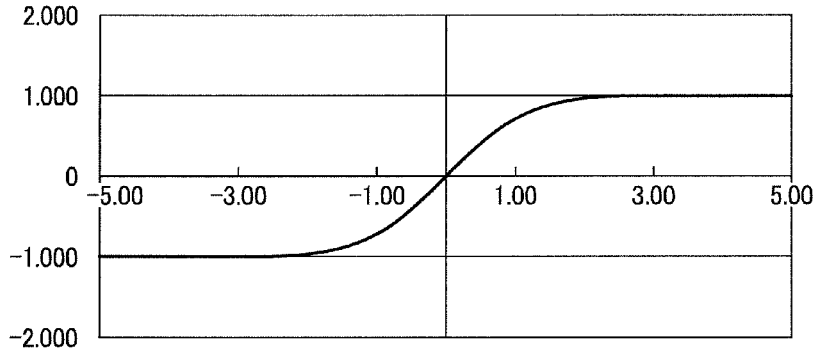
FIGS. 16A and 16B are a hyperbolic tangent equation and a curve thereof to be used as a function that expresses an approximate curve, and an approximate curve obtained based on the hyperbolic tangent equation.
Figure 16B:
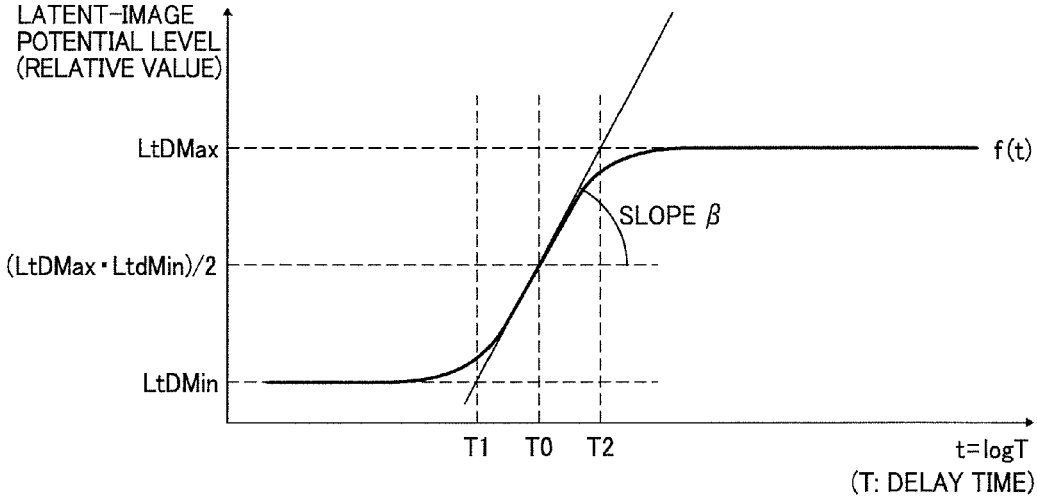

A function of the approximate curves can be expressed based on such a hyperbolic tangent equation as given in FIG. 16A or Equation (1) below so that the function can be expressed as an equation for such a curve as given in FIG. 16B and of which maximum value LtDMax, minimum value LtDMin, and slope β are variables.

$$\tan h(x)=[\exp(x)-\exp(-x)]/[\exp(x)+\exp(-x)] \quad (1)$$

Hence, measurement can be carried out by setting TI and T2 as follows.

TI: intersection between LtDMin and straight line passing thorough T0 and having the slope β

T2: intersection between LtDMax and straight line passing thorough T0 and having the slope β

Figure 15:
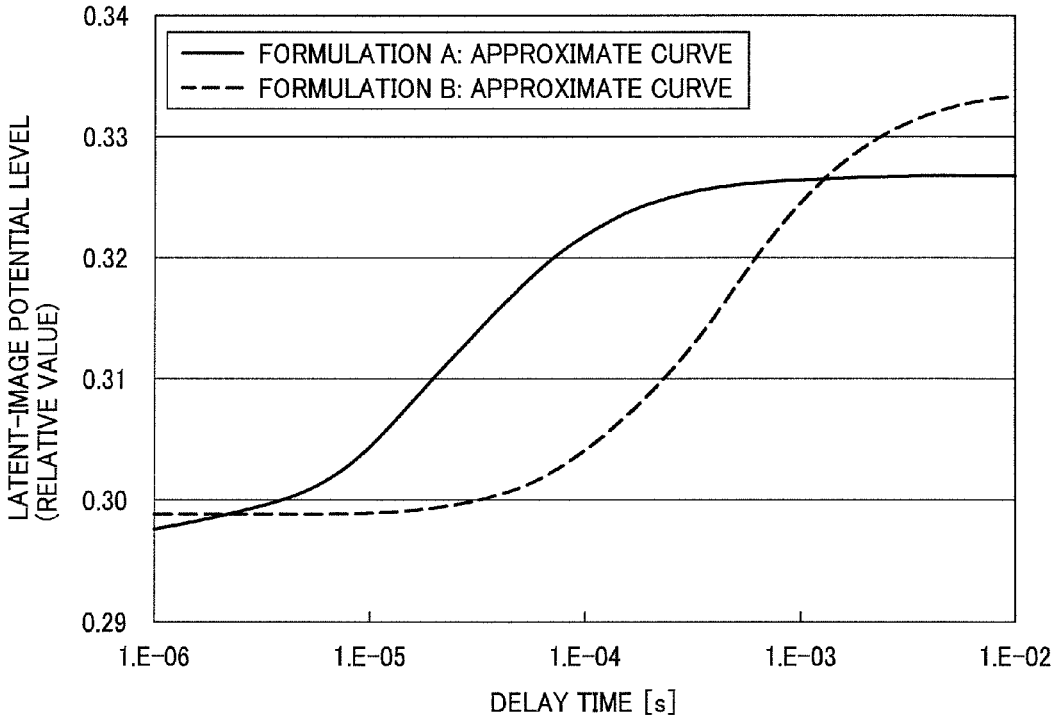
FIG. 15 is a diagram where measurement values of formulations A and B given in FIG. 14 are represented by approximate curves.

Referring to the measurement results of FIG. 14 and FIG. 15, delay time of the formulation A is shorter than that of the formulation B and the curve of the formulation A rises faster. Put another way, transition time from the condition A to the condition B and transition time from the condition B to the condition C are short.

The following measurement results of carrier transit time are obtained.

Formulation A:

period of time before reaching inflection point T0: 26 μs carrier transit time T2: 122 μs Formulation B:

period of time before reaching inflection point T0: 450 μs carrier transit time T2: 2548 μs It is indicated that the formulation A is shifted to the left, or to the short-time side, 20 times as far as that of the formulation B. Meanwhile, the following conditions have been obtained.

$$f \leqq (m-1)/T2$$

$$m=2$$

Therefore, a scanning frequency f that will not cause uneven image density due to reciprocity law failure to occur when a method of attaining a required exposure by performing two-surface scanning at minimum is employed is obtained as follows.

formulation A: f≦8197 Hz formulation B: f≦392 Hz

An appropriate one of the formulations can be selected depending on a required scanning frequency.

For example, if a required scanning frequency f determined by linear velocity of a photosensitive member is 1667 Hz, the formulation A is desirably selected.

Figure 17:
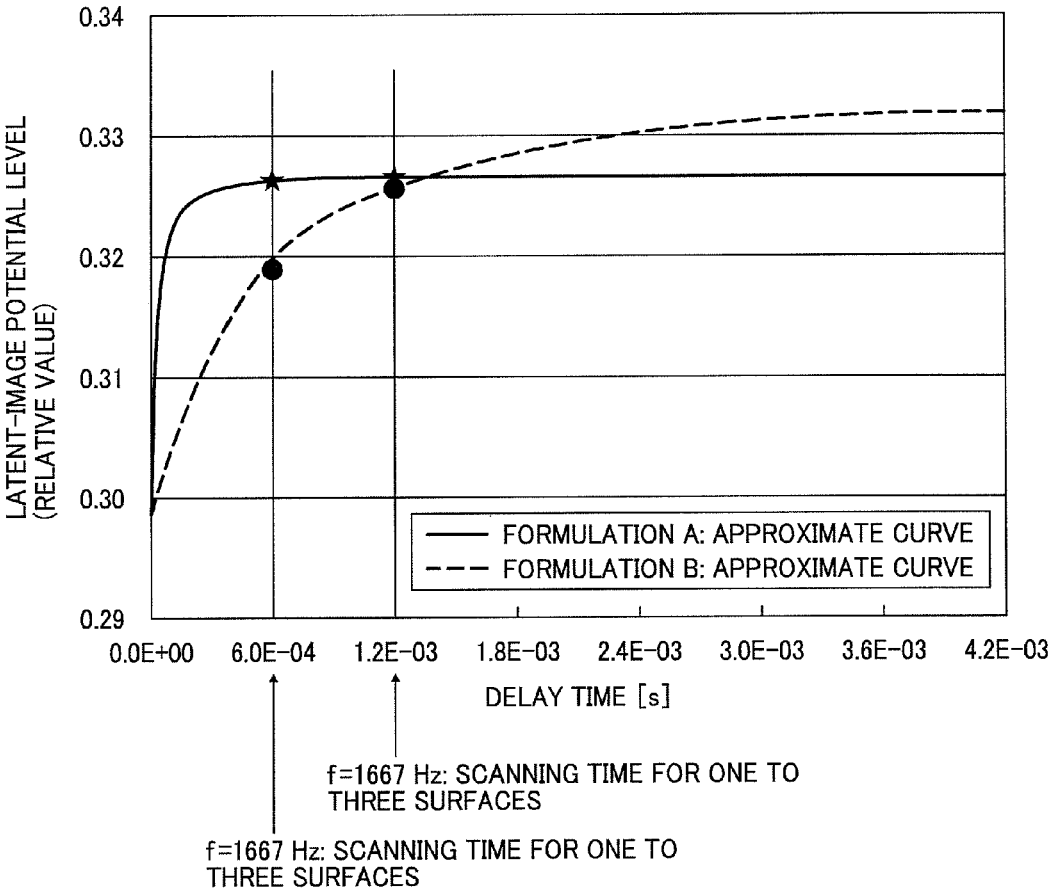
FIG. 17 is a plot of the same values as those of FIG. 16 but spaced in linear scale on the horizontal axis.

FIG. 17 is a plot of the same values as those of FIG. 15 but spaced in linear scale on the horizontal axis.

When comparison is made at the scanning frequency f=1667 Hz (T=1/f=600 μs), changes in depth between two surface exposure and three-surface exposure are as follows.

formulation A: 0.09% formulation B: 1.92%

These are converted to values at a charge potential −900 volts. While a converted value related to the formulation A is 0.9 volt, which is as small as practically negligible, a converted value related to the formulation B is 17.3 volts, which so large as to affect image density of an output image.

This indicates that distilbene compound is appropriate as the charge transport material.

When a method of attaining a required exposure by performing four-surface scanning at minimum is employed, a scanning frequency is desirably set as follows.

formulation A: f≦24590 Hz formulation B: f≦1177 Hz

Accordingly, by increasing the number of surfaces of multiple exposure, a scanning frequency equal to or higher than 1 kHz, which is practically available, can be used even with the formulation B.

Figure 18:
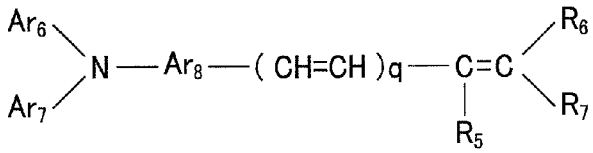
FIG. 18 illustrates a general formula of an example distilbene compound.

When the charge transport material is to be used in the condition C, a material that provides relatively short transit time and has relatively high electrostatic property is desirably selected as the charge transport material. In particular, distilbene compound is desirably used as the charge transport material. A general formula of an example distilbene compound is given in FIG. 18. Photosensitive members with use of distilbene compound are discussed in detail in Japanese Patent Application No. 2000-137339, which is a prior application by the present applicant.

With the image forming apparatus according to the sixth embodiment, use of the latent image carrier that contains distilbene compound increases process quality at each process, whereby high-image quality, high durability, high stability, and energy savings are provided. Use of the optical scanning apparatus described in the first to fourth embodiments provides an image forming system that causes reciprocity law failure less likely to occur, thereby providing an image forming apparatus free from uneven image density.

Meanwhile, a linear velocity V, expressed in mm/s, of a photosensitive member can be expressed by Equation (2) below by using the scanning frequency f and a travel $\rho_y$ per scan stroke in the sub-scanning direction expressed in dots per inch (dpi):

$$V=(25.4/\rho_y)\cdot f \quad (2)$$

where $p_y$=(sub-scanning write density (dpi))/((the number of light sources)·(the number of surfaces m with which required exposure is attained)).

As density of image forming apparatuses increases, sub-scanning write density equal to or higher than 4800 dpi has been demanded in recent years. To realistically attain this with cost taken into consideration, the number of light sources is desirably approximately 30 to 40 and m is equal to or larger than 2; and f≧1 kHz is desirably satisfied to ensure linear velocity of a photosensitive member equal to or higher than 200 mm/s.

Therefore, a latent image carrier of which actual carrier transit time from a charge generation layer to a surface is equal to or shorter than 1 ms is desirably used.

Any bonding resin that has favorable insulation and conventionally known as bonding resin for use in electrophotographic photosensitive member can be used as bonding resin for use in forming the charge generation layer (CGL) and/or the charge transport layer (CTL), and no specific limitation is imposed thereon.

As described above, use of a latent image carrier that provides appropriate transit time, which is an important characteristic value that affects on latent image formation, leads to provision of an image forming apparatus that forms a high-density image free from uneven image density at high speed. By using the optical scanning apparatus described in the first to fourth embodiments, an image forming system that causes reciprocity law failure less likely to occur is provided, thereby providing an image forming apparatus free from uneven image density.

According to an aspect of the present invention, an optical scanning apparatus free from uneven image density is provided.

According to another aspect of the present invention, an optical scanning apparatus capable of preventing uneven image density is provided.

According to still another aspect of the present invention, an optical scanning apparatus capable of preventing uneven image density when scanning is performed by multiple exposure is provided.

With a conventional method, use of a multi-channel light source, such as a VCSEL, leads to uneven image density as well as encounters adjustment difficulty due to the large number of light sources. In contrast, by adapting a method according to still another aspect of the present invention, an optical scanning apparatus capable of preventing uneven image density is provided.

This serves as implementation of a countermeasure against cause of uneven image density, thereby improving image quality of an output image.

According to still another aspect of the present invention, an image forming system that causes reciprocity law failure less likely to occur is provided, which leads to provision of an image forming apparatus that forms a high-quality image free from uneven image density.

According to still another aspect of the present invention, an image forming system that causes reciprocity law failure less likely to occur is provided, which leads to provision of an image forming apparatus free from uneven image density.

Use of a latent image carrier that contains distilbene compound increases process quality at each process, whereby high image quality, high durability, high stability, and energy savings can be attained.

According to still another aspect of the present invention, an image forming system that causes reciprocity law failure less likely to occur is provided, which leads to provision of an image forming apparatus free from uneven image density.

Use of a latent image carrier that provides appropriate transit time, which is an important characteristic value that affects on latent image formation, leads to provision of an image forming apparatus capable of forming a high-density image free from uneven image density at a high speed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning apparatus comprising:

an optical deflector having deflective reflection surfaces that deflect a light beam at a substantially constant angular velocity;

an optical system that condenses a light beam deflected from the reflection surface of the optical deflector into a light spot on a to-be-scanned surface thereby performing optical scanning of the to-be-scanned surface at the substantially constant velocity, wherein the to-be-scanned surface is a surface of a latent image carrier having a charge generation layer that generates carriers and a charge transport layer; and a driving unit that drives the optical deflector at a scanning frequency at which exposure is attained in a state where some of the carriers generated at the charge generation layer of the latent image carrier exist inside the charge generation layer or on an outermost surface and the carriers substantially stay still.

2. The optical scanning apparatus according to claim 1, wherein the scanning frequency satisfies f≧1/T1, where f is the scanning frequency expressed in hertz and T1 is an actual transit time expressed in seconds of the carriers generated at the charge generation layer of the latent image carrier from the charge generation layer to the charge transport layer.

3. The optical scanning apparatus according to claim 1, wherein the apparatus is configured to perform m-surface scanning (m>1) and the scanning frequency satisfies $f \leqq (m-1)/T2$, where f is the scanning frequency expressed in hertz and T2 is an actual period of time expressed in seconds it takes for the carriers generated at the charge generation layer of the latent image carrier to reach a surface of the latent image carrier.

4. The optical scanning apparatus according to claim 1, wherein the light source is a multi-beam light source.

5. The optical scanning apparatus according to claim 4, wherein the multi-beam light source is a vertical-cavity surface-emitting laser.

6. An image forming apparatus that forms an electrostatic latent image on a latent image carrier by optical scanning and develops the electrostatic latent image into a visible image to thereby record a desired image, the image forming apparatus comprising the optical scanning apparatus according to claim 1.

7. An image forming apparatus that forms an electrostatic latent image on a latent image carrier that uses distilbene compound as charge transport material by optical scanning and develops the electrostatic latent image into a visible image to record a desired image, the image forming apparatus comprising the optical scanning apparatus according to claim 1.

8. An image forming apparatus that forms an electrostatic latent image on a latent image carrier by optical scanning and develops the electrostatic latent image into a visible image to record a desired image, the image forming apparatus comprising the optical scanning apparatus according to claim 1, wherein the latent image carrier has actual transit time that is equal to or shorter than 1 millisecond, the actual transit time being actual transit time of the carriers that drift from the charge generation layer to a surface of the latent image carrier.

9. The optical scanning apparatus according to claim 1, wherein the driving unit is configured such that a state of a latent image generated by the apparatus is prevented from varying even when the latent image is formed by multiple-surface scanning.

10. The optical scanning apparatus according to claim 1, wherein the driving unit is configured such that the number of carriers that reach the outermost surface is prevented from varying even when a latent image is formed by multiple-surface scanning.

11. An exposure method comprising:

deflecting a light beam from a light source at a substantially constant angular velocity by an optical deflector having deflective reflection surfaces; and performing optical scanning by condensing the deflected light beam into a light spot on a to-be-scanned surface by a scanning-and-image-forming optical system, wherein the to-be-scanned surface is a surface of a latent image carrier having a charge generation layer and a charge transport layer, and wherein the exposure method further comprises:

determining a state of carriers, generated in the charge generation layer of the latent image carrier, in the charge transport layer; and performing exposure when the state of carriers is a state where part of the carriers generated in the charge generation layer of the latent image carrier exist inside the charge generation layer or on an outermost surface.

* * * * *